US006916046B2

(12) United States Patent
Riley et al.

(10) Patent No.: US 6,916,046 B2
(45) Date of Patent: Jul. 12, 2005

(54) EXPANDABLE INLINE SKATE STORAGE AND WALKING SHOE

(75) Inventors: Richard Anthony Riley, Bridgeport, OH (US); Frank A. Leyshon, Cambridge, OH (US)

(73) Assignee: Richard A. Riley, Bridgeport, OH (US)

( * ) Notice: Subject to any disclaimer, the term of this patent is extended or adjusted under 35 U.S.C. 154(b) by 0 days.

(21) Appl. No.: 10/645,233

(22) Filed: Aug. 21, 2003

(65) Prior Publication Data

US 2005/0040638 A1 Feb. 24, 2005

(51) Int. Cl.[7] ..... A63C 3/12
(52) U.S. Cl. ..... 280/825
(58) Field of Search ..... 280/811, 845, 280/7.13; D21/772

(56) References Cited

U.S. PATENT DOCUMENTS

D189,854 S * 3/1961 Kesner ..... D21/772
3,015,492 A * 1/1962 Kesner et al. ..... 280/825
4,392,674 A * 7/1983 Evon ..... 280/825
4,413,842 A * 11/1983 Loredo ..... 280/825
5,236,224 A 8/1993 Anderson et al.
5,290,065 A 3/1994 Kassal
5,303,955 A 4/1994 Zurnamer
5,445,415 A 8/1995 Campbell
5,513,881 A * 5/1996 DiMeglio et al. ..... 280/825
5,573,275 A 11/1996 Smith et al.
5,580,094 A 12/1996 Ruehlman et al.
5,765,870 A 6/1998 Riley

FOREIGN PATENT DOCUMENTS

EP 1112760 * 7/2001

* cited by examiner

*Primary Examiner*—Bryan Fischmann
(74) *Attorney, Agent, or Firm*—Gerald Baracka

(57) ABSTRACT

An expandable shoe for inline skates having front and rear shoe portions with wheel receiving channels and upwardly extending blocking means is provided. A flexible bridge connecting said front and rear shoe portions pulls the shoe portions toward each other when the skate wheels are inserted so that the blocking means engage the front and rear wheels with sufficient force to secure the shoe for walking or storage.

20 Claims, 3 Drawing Sheets

EXPANDABLE INLINE SKATE STORAGE AND WALKING SHOE

FIELD OF INVENTION

The present invention relates to an expandable guard or shoe that can be slipped over the wheels of an inline skate for comfortable walking and, when the skates are not in use, for storage.

BACKGROUND OF THE INVENTION

Inline skates, also referred to as roller blades, having multiple wheels in a straight line one directly behind the other are known in the art, as are the problems associated with their storage and use. Various covers, guards and shoes which can be attached to the skates have been developed to overcome these problems.

Anderson, et. al., U.S. Pat. No. 5,236,224 disclose a removable wheel cover consisting of a front boot and rear boot connected by a pair of flexible straps. The cover is attached by the user hooking the cover over the skates rear wheel and then pulling the cover forward over the front wheel. A disadvantage of the Anderson, et. al., covers is that the flat bottom surface of the front and rear boots is relatively narrow—only approximately the width of the skate wheels so that the skate will not stand in an upright position for storage or give ankle support and stability for walking. Furthermore, attachment requires the use of one or both hands and safety dictates they be seated when making the attachment.

Kassal, U.S. Pat. No. 5,290,065 disclose a wheel immobilizing cover which includes an elongated channel with a fixed bridge to capture the front skate wheel and an adjustable rear bridge to capture the rear wheel. While the device allows for immobilization and protection of the skate wheels, it will not maintain the skate in and upright position for storage nor does it provide adequate ankle support and stability for walking.

Zurnamer, U.S. Pat. No. 5,303,955 discloses a formed envelope-shaped body of flexible material with a rubbery bottom to receive and contain inline skate wheels. The cover has a strap at it's rear with a clip for connecting to the back of the boot portion of the skate. While the cover does protect the skate wheels from dirt and moisture during periods of storage, the covers do not provide an adequate base for upright storage or comfortable walking.

Campbell, U.S. Pat. No. 5,445,415 provides a flexible cover for attachment over the wheels of inline roller skates with an elongated holding channel and strap extensions to wrap around the users leg. This cover has the same deficiencies as the previously mentioned device, i.e., inadequate support/stability for comfortable walking and upright storage.

Smith, et. al., U.S. Pat. No. 5,573,275 discloses an inline skate guard comprising a main body portion, a substantially solid base member with opposing left and right substantially rigid sidewalls extending upwardly thereform to create a wheel-receiving trough, a ground contacting bottom surface and first and second securing members for looped engagement to the respective toe and rear portions of the skate boot. In addition to the cumbersome securing means, which could also be a safety hazard if the user were to insert the loops in the wrong slots causing looseness and allowing the guard to shift, the guard does not provide sufficient flexibility to accommodate different size skates. For example, while the distance from the furthest protrusion of the front wheel to the protrusion of the rear wheel for a size 8 skate with 68 mm wheels is 12 inches, the corresponding distance for the same size skate with 76 mm wheels is 13½ inches.

Ruehlman, et. al., U.S. Pat. No. 5,580,094 discloses a removable inline skate guard having an elongated channel to receive the skate wheels with an upwardly curved forward portion to inwardly receive and engage the front wheel and an adjustable bridle to attach the guard to the rear of the skate. To allow for use with different size skates, the reference teaches that the rear open end of the channel may be cut off as required to render the length of the channel more compatible with the length of the blade. After such modification, however, the guard would be suitable for use only on similarly sized skates. Furthermore, the reference guards are too narrow to support the skate in an upright position for storage or offer sufficient stability for comfortable walking.

Riley, U.S. Pat. No. 5,765,870 discloses an adjustable shoe for inline skates having front and rear shoe portions connected by a track that permits the front and rear portions to be moved relative to each other. A cavity in the front and rear portions is sized and shaped to receive the chassis and wheels of the skate and adjustable side plates and straps are provided to secure the shoe to the inline skate. The problem when using this shoe is that one must manually adjust the length of the track connecting the two halves of the shoe to fit the length of the wheels depending on the skate size. In addition, after the track length adjustments are made, in order to secure the skate shoe to the skate one must bend or stoop to fasten the two securing straps. This is an inconvenient method of mounting and securing the skate shoe. One cannot pass them on to another user without readjusting the length of the shoe to adapt to different size skates. If this adjustment is not performed the shoe may not fit properly causing a safety hazard.

There is a continuing need for an expandable inline skate shoe that can be used with different size skates without the need of constant adjustments. There is a further need for an inline skate shoe capable of maintaining the skate in an upright position during storage and providing a good ankle support and stability for comfortable walking. It would further be advantageous if the shoe could be attached to the inline skate without the use of straps. These and other advantages are obtained with various embodiments of the expandable inline skate shoe of the present invention which will be described in detail to follow.

SUMMARY OF THE INVENTION

The present invention is a unique guard or shoe for secure attachment to the inline skate to provide ankle support and stability for comfortable walking. Alternatively, the attached shoe maintains the inline skate in an upright position for storage.

The shoe is designed for use with an inline skate having a series of wheels rotatably mounted in an inline configuration on a wheel receiving frame having two substantially parallel elongated rail portions secured to the toe and heal portions of a boot. The shoe receives the linearly aligned wheels of an inline skate in a wheel-receiving channel having upwardly extending, concavely curved blocking means to engage the foremost and rearmost wheels thereby securely attaching the shoe to the skate for safe ambulation or convenient storage.

More specifically, the expandable shoe is comprised of a front portion and rear shoe portion which are substantially solid horizontally disposed elongated members having a ground-contacting bottom surface and substantially rigid opposed left and right sidewalls extending upwardly therefrom so as to define a wheel-receiving channel. The front and rear shoe portions, having a gap between them, are connected by means of a flexible bridge. The flexible bridge which maintains the front and rear shoe portions in substantial horizontal alignment comprises two stretchable, i.e. extensible, substantially parallel elongate connecting members. These elongate connecting rail members extend longitudinally between the front and rear shoe portions and are located outside the vertical planes of the left and right sidewalls of the wheel-receiving channels so as not to interfere with the wheels when they are inserted in said channels. The connecting members may be integrally molded with the front and rear shoe portions or may be separately molded and attached to the front and rear shoe portions.

The channel of the front shoe member is shaped and sized to receive the foremost wheels of an inline skate and has a blocking means disposed at the front of said channel to engage the front wheel. The blocking means extends upwardly from said channel at least 27.5 degrees above the horizontal plane of the axes of the skate wheels and is concavely curved so as to generally conform to the curvature, i.e., circumference, of the front wheel of the inline skate.

The channel of the rear shoe member is shaped and sized to receive the rearmost wheels of an inline skate and has a blocking means disposed at the rear of said channel to engage the rear wheel. The blocking means extends upward from said channel and is concavely curved so as to generally conform to the curvature of the rear wheel of the inline skate.

The extensible rail members connecting said front and rear wheel-receiving members have sufficient elasticity and are of such a length that, when under tension, the front and rear shoe portions are pulled toward each other and the blocking means disposed at the front and rear of the respective wheel-receiving channels engage and respectively bear against the front and rear wheels of the inline skate inserted therein with sufficient force so as to provide secure attachment of the shoe to the inline skate wheels.

In one embodiment of the invention, where the shoe is utilized with an inline skate which has no rear brake or where there is sufficient clearance between the rear skate wheel and the brake assembly, the blocking means of the rear shoe portion will also extend upwardly from the wheel-receiving channel at least 27.5 degrees above the horizontal plane of the axes of the skate wheels when inserted in said channel. In this situation the expandable shoe is securely attached and maintains the skate in a generally upright position for storage or walking. In those instances where the inline skate has a rear brake assembly which does not provide sufficient clearance for rear blocking means extending 27.5 degrees above the skate wheel axes, the rear blocking means will be shortened and it may be necessary to utilize a strap to secure the rear shoe portion to the inline skate. This can be accomplished utilizing a flexible elastic strap attached to the left and right sidewalls of the rear shoe portion and which forms a loop which can be stretched over the rear brake assembly. Alternatively, a first strap connected to one of the sidewalls of the rear shoe portion, a second strap attached to the opposite side wall and a means for connecting said first and second straps and adjusting for a secure fit when one of the straps is looped over the brake assembly can be utilized. When straps are utilized, they are attached to the rear shoe portion.

In an especially useful embodiment, the blocking means of the front shoe portion extends from 27.5 to 60 degrees and, more preferably, from 32.5 to 50 degrees above the horizontal plane of the axes of the skate wheels. In a further useful embodiment the front and rear shoe portions may be slightly wider at the base, i.e., at the ground-contacting bottom surface.

The above embodiments and objectives will become more apparent from the accompanying drawings and detailed description with reference to the drawings which follow.

DETAILED DESCRIPTION OF PREFERRED EMBODIMENTS

Figure 1:
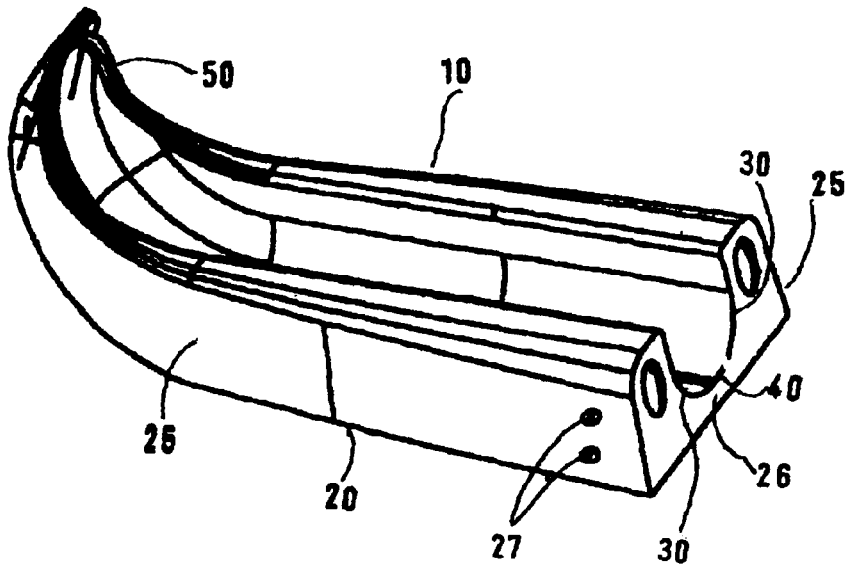
FIG. 1 is a perspective view of a front shoe portion.
Figure 2A:
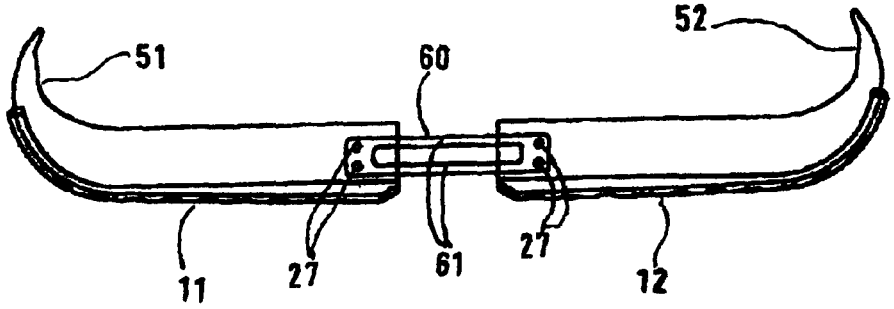
FIG. 2*a* is a side view of an expandable shoe with front and rear shoe portions connected by a flexible bridge.
Figure 2B:
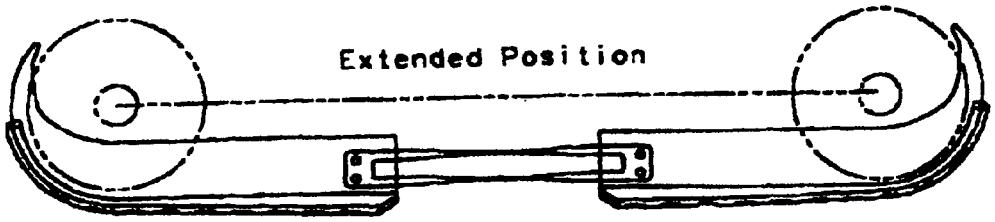
FIG. 2*b* shows the shoe in expanded form with the front and rear skate wheels shown in ghost outline.

Reference will now be made to FIGS. 1, 2*a* and 2*b*, which show a first embodiment of the expandable shoe of the invention. FIG. 1 shows a front or rear shoe portion alone whereas FIG. 2*a* shows front and rear portions connected by means of a flexible bridge. FIG. 2*b* shows front and rear portions in extended form with wheels inserted. Only the front and rear wheels of the skate are depicted in ghost outline. For this embodiment the front and rear shoe portions are identical or substantially identical and are comprised of a substantially solid horizontally disposed elongated base number 10 having a ground-contacting bottom surface 20. The base member is substantially rigid and made from a tough plastic material. Alternatively, rubber materials which are cured can also be used. Rigid opposing sidewalls 30 extend upwardly within the base member and form a channel shaped and sized to define a wheel-receiving channel 40. The wheel-receiving channel extends the length of base member 10 with blocking means 50 disposed at the end. Blocking means 50 is formed by the upward curvature of the wheel-receiving channel 40 and is concavely curved to generally conform to the curvature of the inline skate wheel when placed in the wheel-receiving channel. Blocking means 50 extends above the horizontal plane of the axes of the skate wheels, when inserted in wheel receiving channel 40, at least 27.5 degrees. Typically blocking means 50 extends 27.5 to 60 degrees above the horizontal plane of the axes of the skate wheels. In a highly preferred embodiment, blocking means 50 extends 32.5 to 50 degrees above the horizontal plane of the axes of the skate wheels inserted in wheel-receiving channel 50. Typically the depth of wheel wheel-receiving channel 40 is such so as to allow the skate wheels to contact the bottom of the channel. The skate wheels will normally be in contact with the bottom of the channel unless the skate wheels are significantly worn, in which case, the elongated rails to which the wheels are mounted will contact the top of the channel and support the skate. Outside walls 25 of base member 10 may be perpendicular but most preferably, will have a slight taper from the bottom to the top so as to provide a slightly wider ground-contacting bottom surface for greater stability. Further, base member 10 is tapered from back wall 26 toward blocking means 50. Whereas opposing sidewalls 30 are substantially parallel over the length of base member 10, outside walls 25 are not parallel but rather define a ground-contacting bottom surface 20 which is generally about 2 to 2½ inches wide at back wall 26 tapering to less than 2 inches where, due to the upward curvature of base member 10 to accommodate blocking means 50, bottom surface 20 no longer is in contact with a flat surface on which it is placed.

Elongated base member 10 may be a rigid solid piece, i.e. having no internal cavities, formed by molding a single material, or it may be a rigid molded piece having internal cavities and reinforcing members to impart strength and rigidity. Base members of the latter type may be utilized as such in which case an appropriately sized sole would be adhered to the bottom of the base member to provide a suitable ground-contacting surface. Another alternative is to mold a second material to rigid members having internal cavities. In this way a rubber material having elastomeric characteristics could be combined with a more rigid thermoplastic to utilize the best characteristics of both materials. While the wheel-receiving channel, blocking means and outside walls would have the necessary stiffness to provide the desired stiffness and structural integrity to the base member, the ground-contacting bottom surface would have the necessary flexibility to provide good cushioning and gripping for the wearer. This double molding or overmolding approach can also be utilized to form the flexible bridge connecting two base members as will be more fully explained herein.

Elongated base member 10 may also have one or more bridge fastening means 27 molded onto outside walls 25 to provide for attachment of flexible bridge 60 as illustrated in FIG. 2*a*. Bridge fastening means 27 may be suitable pins or threaded inserts to which screws may be attached. Alternatively, screws for attaching flexible bridge 60 may be screwed directly into base member 10 depending on the type of material(s) used for the construction.

Base member 10 can be utilized as the front shoe portion 11 and rear shoe portion 12 of an expandable shoe as illustrated in FIG. 2*a*. This type of shoe would be suitable for use with inline skates having no rear brake assembly. The front blocking means 51 and rear blocking means 52 could be identically constructed or different but in either case blocking means 51 and 52 would extend upwardly from the wheel-receiving channel at least 27.5 degrees above the horizontal plane of the axes of the inline skate wheels. Flexible bridge 60 as illustrated is a molded elastomeric elongated o-shaped piece; however, other designs can be utilized for this purpose. Whereas flexible bridge 60 has two extensible (strechable) rail members 61, constructions having fewer or more stretchable rail members can be employed. An identical flexible bridge which is not shown in FIG. 2*a* would be positioned and attached on the backside of the expandable shoe. The only requirement is that the extensible rail members have sufficient elasticity so that, under tension, front shoe portion 11 and rear portion 12 are pulled toward each other so that blocking means 51 disposed at the front of shoe portion 11 and blocking means 52 disposed at rear of the rear shoe portion 12 engage and bear against the front and rear wheels, respectively, of an inline skate inserted therein with sufficient force so as to provide secure attachment of the shoe to the inline skate. Whereas flexible bridge member 60 may be integrally molded, i.e, formed as a unit with the front and rear shoe portions as will be described in greater detail to follow, constructions as depicted in FIG. 2*a* having front and rear shoe portions 11 and 12, attached using a flexible bridge which is separately molded and attached to the outside walls 25 of the respective shoe portions provide the ability to vary the expandable shoe components. For example, should flexible bridge member 60 fail as a result of heavy or improper usage, it could be replaced with a new piece. Also, if the user were to purchase new skates with a different wheel spacing, longer or shorter, different flexible bridge members could be installed to accommodate the new wheel spacing and insure proper fit and securing of the shoe onto the new skates. In addition to allowing for exchange of the flexible bridge member, a user would also be able to change a shoe portion. For example, if the shoe was originally fitted for a skate with no brake assembly, the user could adapt the shoe for use with an inline skate having a brake assembly by exchanging rear portion 12 with one having a shorter blocking means, and, if necessary to achieve secure attachment, a securing means.

The flexible bridge, whether integrally molded or separately molded and attached, is typically of such a length so as to create a gap of about ¾ to 1¾ inches between the front and rear shoe portions in the relaxed state, i.e. before insertion of the skate wheels. After attachment to the skate i.e. insertion of the skate wheels in the wheel-receiving channels, the gap can expand to about 1½ to 4½ inches depending on the size of the skate and diameter of the wheels.

FIGS. 3–6 illustrate an embodiment of the invention wherein the front shoe portion, flexible bridge and rear shoe portion of the adjustable shoe are integrally molded as a unit. Molding may be accomplished using a single material but is more typically achieved using two different materials, a fairly rigid plastic material for construction of the wheel-receiving channel and blocking means and an elastomeric material for the flexible bridge and ground-contacting bottom surface. This is accomplished in a 2-step operation. First a base member having internal cavities similar to that illustrated in FIG. 1 is molded from a rigid plastic material, such as polyolefin, nylon, polyester, polycarbonate or the like. Two such base members are then positioned in a suitable mold and an elastomeric material, such as thermoplastic polyolefin (TPO) or thermoplastic elastomer (TPE), injected to fill the internal cavities of the two rigid plastic pieces, form a flexible bridge connecting the pieces and form a sole on both pieces. Depending on the mold design used for the overmolding operation, the design of the flexible bridge and ground-contacting bottom surface of expandable shoes produced in this manner can vary extensively.

Figure 3:
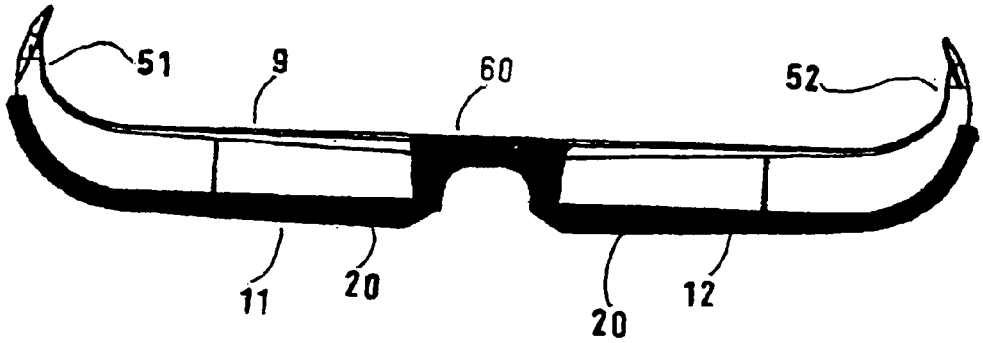
FIG. 3 is a side view of an expandable shoe with front and rear shoe portions and flexible bridge molded as a unit and including a molded sole.
Figure 4:
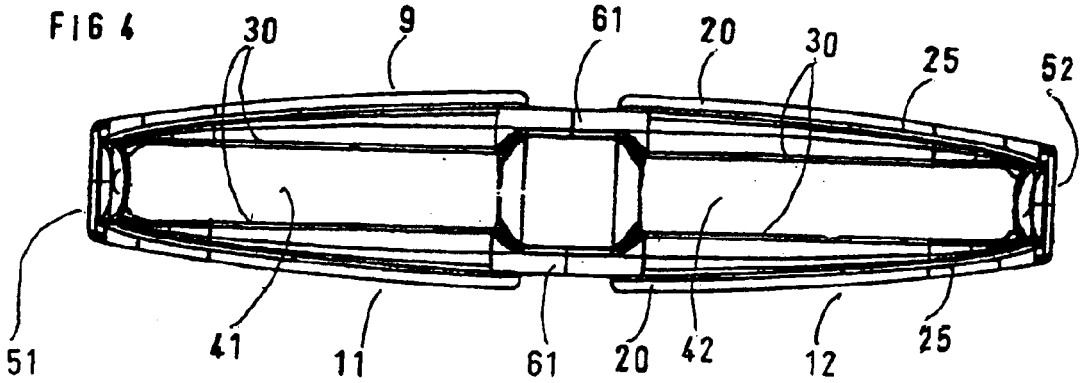
FIG. 4 is a top view of the expandable shoe as shown in FIGS. 3
Figure 5:
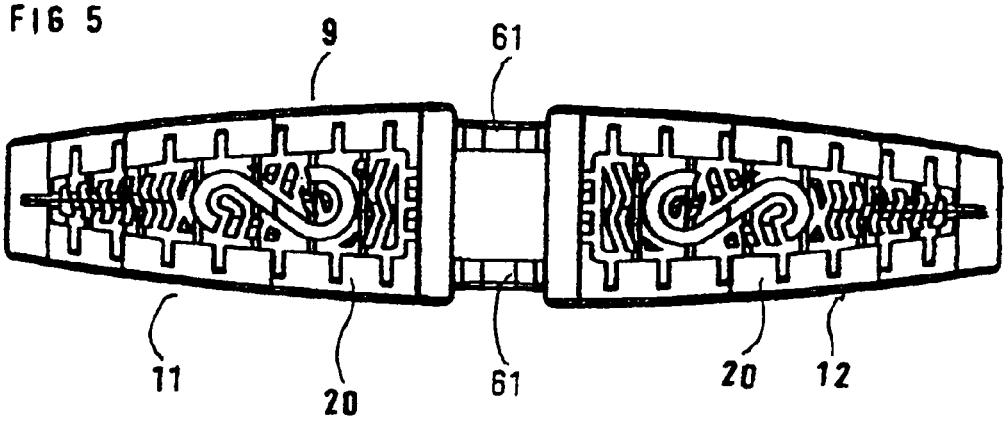
FIG. 5 is a bottom view of the expandable shoe shown in FIGS. 3

FIG. 3 shows an expandable shoe 9 produced as a unit by such an overmolding procedure and suitable for use with an inline skate having no brake assembly. The expandable shoe 9 comprises a front shoe portion 11 and a rear shoe portion 12 and flexible bridge 60. Front shoe portion 11 has a front blocking means 51 and ground-contacting bottom surface 20. As shown in FIG. 4 front shoe portion 11 has a front wheel receiving channel 41 and opposing side walls 30. Front blocking means 51 disposed at the front of receiving channel 41 extends upwardly from said channel and is concavely curved to generally conform to the curvature of the front wheel of an inline skate. Rear shoe portion 12 has opposing side walls 30 extending upwardly so as to define a rear wheel-receiving channel 42. Rear blocking means 52 disposed at the rear of receiving channel 42 extends upwardly from said channel and is concavely curved to generally conform to the rear wheel of and inline skate. Extensible substantially parallel elongate rail member 61 connect front shoe portion 11 and rear shoe portion 12 and maintains said front and rear shoe portions in substantial alignment with a gap therebetween. Extensible rail members 61 are outside the vertical planes of opposing side walls 30 so as not to interfere with the skate wheels when placed in wheel-receiving channels 41 and 42. Extensible rail members 61 have sufficient elasticity so that when under tension, front shoe portion 11 and rear shoe portion 12 are pulled toward each other so that front blocking means 51 and rear blocking means 52 engage and bear against the respective front and rear wheels of an inline skate inserted in expandable shoe 9. The ground-contacting bottom surface 20 of front shoe portion 11 and rear shoe portion 12 may extend beyond the outside walls 25 in order to provide additional stability for walking and storage. As shown in FIG. 5 a tread design may be molded into ground-contacting bottom surface 20.

Figure 6:
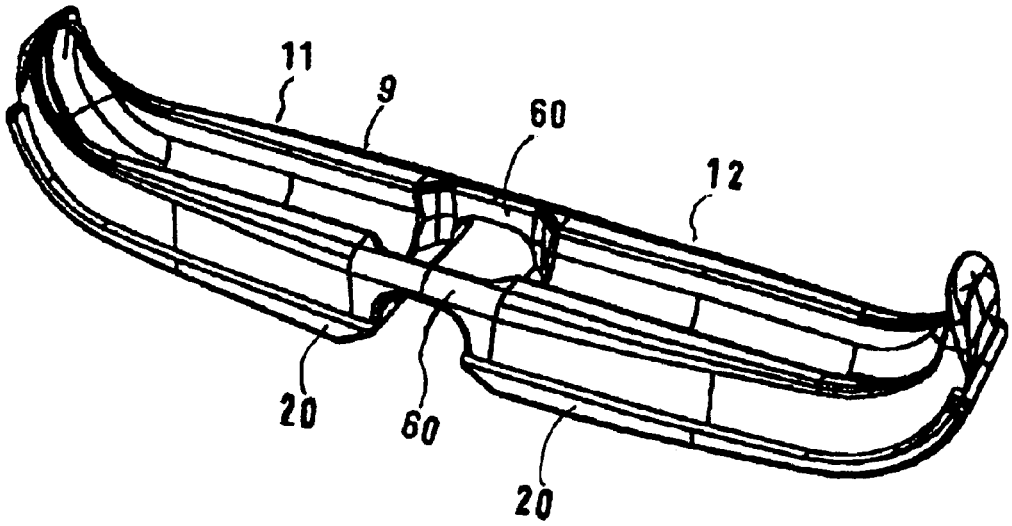
FIG. 6 is a perspective view of the expandable shoe as shown in FIGS. 3

FIG. 6 is a perspective view of an expandable shoe 9 produced using the overmolding procedure and wherein front shoe portion 11, rear shoe portion 12, flexible bridge 60 and ground-contacting bottom surface 20 are molded as a unit.

Figure 7:
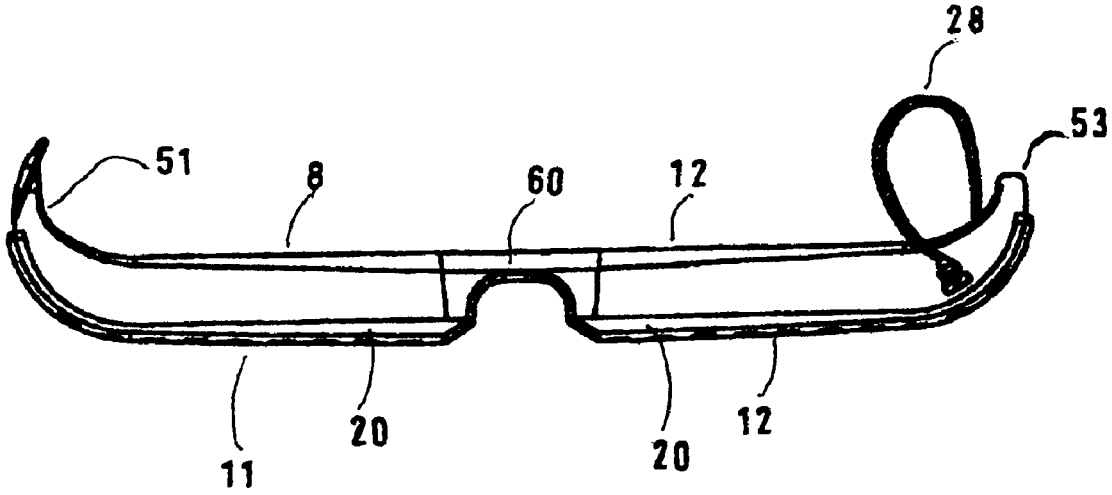
FIG. 7 is a side view of an expandable shoe having a rear portion with securing means for looping over the rear brake assembly.

In FIGS. 2*a*, 2*b*, 3, 4 and 5 are depicted adjustable shoes for use with inline skates having no rear brake assembly or where the rear brake assembly is of such a design that there is sufficient clearance for the rear blocking means to pass between the wheel and the brake. Adjustable shoes of this type are typically attached to the inline skate by the wearer placing the front or rear wheel of the skate in the wheel-receiving channel against the respective blocking means and pressing the foot downward. The shoe will expand and snap around the front and rear skate wheels for secure attachment thereto. FIG. 7 shows an adjustable shoe similar to those depicted in FIGS. 3–6 except that the rear shoe portion 12 has been modified to accommodate use on inline skates having a rear brake assembly which prevents insertion of the rear wheels of an in-line skate into the receiving channel of a rear shoe portion when the rear blocking means which extends upwardly from said channel 27.5 degrees or more above the horizontal plane of the axes of the skate wheels. In this instance the rear blocking means is shortened and a securing means attached to the side walls of the rear shoe portion. The securing means may be a loop of flexible elastic material or straps with connecting means such as a buckle, loop and hook, VELCRO® hook and loop fastener or the like. The straps are typically made of non-elastic material such as leather, plastic or fabric. Ends of securing means are attached by suitable means to the rear half of the opposing side walls of the rear shoe portion.

FIG. 7 shows an adjustable shoe 8 suitable for attachment to an inline skate with a rear brake assembly having front and rear shoe portions 11 and 12, front blocking means 51, flexible bridge 60, ground-contacting bottom surface 20, modified rear blocking means 53 and securing means 28 consisting of a loop of elastic material. Other modifications of the design and construction of the expandable inline skate shoes are within the spirit of the invention and scope of the following claims.

We claim:

1. An expandable shoe capable of being secured to an inline roller skate having a series of wheels rotatably mounted in an inline configuration and maintaining said skate in a generally upright position for comfortable walking or easy storage comprising:

a front shoe portion comprising a horizontally disposed elongated base member having outside walls, ground-contacting bottom surface and substantially rigid opposed left and right side walls extending upwardly therefrom so as to define a front wheel-receiving channel shaped and sized to receive the foremost wheels of an inline skate and blocking means disposed at the front of said front channel to engage the front wheel, said blocking means extending upwardly from said front channel at least 27.5 degrees above the horizontal plane of the axes of the foremost skate wheels when inserted in said front channel and concavely curved to generally conform to the curvature of the front wheel;

a rear shoe portion comprising a horizontally disposed elongated base member having outside walls, ground-contacting bottom surface and substantially rigid opposed left and right side walls extending upwardly therefrom so as to define a rear wheel-receiving channel shaped and sized to receive the rearmost wheels of an inline skate and blocking means disposed at the rear of said rear channel to engage the rear wheel, said blocking means extending upwardly from said rear channel at least 27.5 degrees above the horizontal plane of the axes of the rearmost skate wheels when inserted in said rear channel and concavely curved to generally conform to the curvature of the rear wheel;

said front and rear shoe portions having a gap therebetween and connected and maintained in substantially horizontal alignment by a flexible bridge consisting of extensible substantially parallel elongate connecting rail members extending longitudinally across said gap and outside the vertical planes of the left and right side walls of the front and rear wheel-receiving channels; and said extensible connecting rail members having sufficient elasticity so that, under tension, the front and rear shoe portions are pulled toward each other and the blocking means disposed at the front and rear of the respective wheel-receiving channels engage and bear respectively against the front and rear wheels of an in-line skate inserted therein with sufficient force so as to provide secure attachment of the shoe to the in-line skate.

2. The expandable shoe of claim 1 wherein the blocking means of said front shoe portion and said rear shoe portion extends from 27.5 to 60 degrees above the horizontal plane of the axes of the respective skate wheels when inserted therein.

3. The adjustable shoe of claim 1 wherein the base members of said front and rear shoe portions are tapered from bottom to top so as to provide a slightly wider ground-contacting bottom surface.

4. The adjustable shoe of claim 1 wherein said flexible bridge is attached to the outside walls of said front and rear shoe portions.

5. The adjustable shoe of claim 1 wherein the flexible bridge is integrally molded with said front and rear shoe portions.

6. The adjustable shoe of claim 1 wherein the base members of said front and rear shoe portions have internal cavities.

7. The adjustable shoe of claim 1 wherein the base members of said front and rear shoe portions are substantially solid.

8. The adjustable shoe of claim 7 wherein the substantially solid base members of said front and rear shoe portions are obtained by overmolding a rigid thermoplastic base member having internal cavities with an elastomeric material.

9. The adjustable shoe of claim 8 wherein the flexible bridge is integrally molded with said front and rear shoe portions during said overmolding.

10. An expandable shoe capable of being secured to an inline roller skate having a series of wheels rotably mounted in an inline configeration and a rear brake and maintaining said skate in a generally upright position for comfortable walking or easy storage comprising:

a front shoe portion comprising a horizontally disposed elongated member having outside walls, ground-contacting bottom surface and substantially rigid opposed left and right side walls extending upwardly therefrom so as to define a front wheel-receiving channel shaped and sized to receive the foremost wheels of an inline skate and blocking means disposed at the front of said front channel to engage the front wheel, said blocking means extending upwardly from said front channel at least 27.5 degrees above the horizontal plane of the axes of the skate formost wheels when inserted in said front channel and concavely curved to generally conform to the curvature of the front wheel;

a rear shoe portion with securing means comprising a horizontally disposed elongated member having outside walls, ground-contacting bottom surface and substantially rigid opposed left and right side walls extending upwardly therefrom so as to define a rear wheel-receiving channel shaped and sized to receive the rearmost wheels of an inline skate and blocking means disposed at the rear of said rear channel to engage the rear wheel, said blocking means extending upwardly from said rear channel and concavely curved to generally conform to the curvature of the rear wheel, and said securing means attached to the outside walls and extending upwardly and of sufficient length that it will extend over the brake assembly;

said front and rear shoe portions having a gap therebetween and connected and maintained in substantially horizontal alignment by a flexible bridge consisting of extensible substantially parallel elongate connecting rail members extending longitudinally across said gap and outside the vertical planes of the left and right sidewalls of the front and rear wheel-receiving channels; and said extensible connecting rail members having sufficient elasticity so that, under tension, the front and rear shoe portions are pulled toward each other and the blocking means disposed at the front and rear of the respective wheel-receiving channels engage and bear respectively against the front and rear wheels of an in-line skate inserted therein.

11. The expandable shoe of claim 10 wherein the blocking means of the front shoe portion extends from 27.5 to 60 degrees above the horizontal plane of the axes of the foremost skate wheels when inserted therein.

12. The expandable shoe of claim 10 wherein the securing means of the rear shoe portion consists of a flexible elastic strap attached at either end to the rear half of the outside walls and forming a loop which can be stretched over the rear brake assembly.

13. The expandable shoe of claim 10 wherein the securing means of the rear shoe portion consists of a first strap connected to the rear half of one of the outside walls and a second strap connected to the rear half of the opposite outside wall and a means for connecting said first and second straps and adjusting for a tight fit when one of the straps is looped over the brake assembly.

14. The adjustable shoe of claim 10 wherein the base members of said front and rear shoe portions are tapered from bottom to top so as to provide a slightly wider ground-contacting bottom surface.

15. The adjustable shoe of claim 10 wherein said flexible bridge is attached to the outside walls of said front and rear shoe portions.

16. The adjustable shoe of claim 10 wherein the flexible bridge is integrally molded with said front and rear shoe portions.

17. The adjustable shoe of claim 10 wherein the base members of said front and rear shoe portions have internal cavities.

18. The adjustable shoe of claim 10 wherein the base members of said front and rear shoe portions are substantially solid.

19. The adjustable shoe of claim 18 wherein the substantially solid base members of said front and rear shoe portions are obtained by overmolding a rigid thermoplastic base member having internal cavities with an elastomeric material.

20. The adjustable shoe of claim 19 wherein the flexible bridge is integrally molded with said front and rear shoe portions during said overmolding.

* * * * *